US011382439B1

(12) United States Patent
Fink et al.

(10) Patent No.: US 11,382,439 B1
(45) Date of Patent: Jul. 12, 2022

(54) LOCKING CASE SYSTEM AND METHOD FOR COSMETIC PRODUCTS

(71) Applicant: WALGREEN CO., Deerfield, IL (US)

(72) Inventors: Scott Fink, Chicago, IL (US); Nick Farinola, Coppell, TX (US)

(73) Assignee: WALGREEN CO., Deerfield, IL (US)

( * ) Notice: Subject to any disclaimer, the term of this patent is extended or adjusted under 35 U.S.C. 154(b) by 0 days.

(21) Appl. No.: 16/887,477

(22) Filed: May 29, 2020

Related U.S. Application Data

(60) Provisional application No. 62/873,714, filed on Jul. 12, 2019.

(51) Int. Cl.
*A47F 3/00* (2006.01)
*A47F 7/28* (2006.01)

(52) U.S. Cl.
CPC ..... *A47F 3/002* (2013.01); *A47F 7/286* (2013.01)

(58) Field of Classification Search
CPC ..... A47F 3/002; A47F 7/286
USPC ..... 220/4.31
See application file for complete search history.

(56) References Cited

U.S. PATENT DOCUMENTS 628,778 A * 7/1899 Edwards ..... B65D 7/24 220/4.31
1,471,757 A * 10/1923 Thiriot ..... B41J 29/13 312/208.4
2,185,770 A * 1/1940 Larson ..... B65D 7/24 220/4.31
2,611,460 A * 9/1952 Nash ..... A47F 5/10 403/382
3,722,971 A * 3/1973 Zeischegg ..... A47B 47/042 312/107
4,171,150 A * 10/1979 Soderlund ..... A47B 47/042 312/107
4,266,835 A * 5/1981 Schmidt ..... B25H 3/02 312/244
4,303,158 A * 12/1981 Perkins ..... B25H 3/02 206/373
4,432,591 A * 2/1984 Rinkewich ..... E06B 9/15 160/232
4,502,741 A * 3/1985 DeVries ..... A47B 47/042 108/102
4,693,386 A * 9/1987 Hughes ..... B65D 11/1833 220/1.5
4,934,531 A * 6/1990 Chen ..... G11B 23/0236 206/387.12
5,360,263 A * 11/1994 Nakano ..... A47B 47/0075 312/257.1

(Continued)

*Primary Examiner* — Stanton L Krycinski
(74) *Attorney, Agent, or Firm* — Marshall, Gerstein & Borun LLP

(57) ABSTRACT

A locking case system for cosmetic products includes a fixture adapted to receive cosmetic products and a locking case adapted to be coupled to the fixture. Upon coupling the locking case to the fixture, at least one snap member of at least one side wall of the locking case is snapped into at least one receiving portion of the at least one side wall of the fixture. In addition, at least one snap member of a rear wall of the locking case is snapped into at least one receiving aperture in a top edge of a rear wall of the fixture. Further, at least one snap member of a front member of the locking case is snapped into the at least one receiving aperture of a front wall of the fixture to secure the cosmetic products to the fixture.

16 Claims, 8 Drawing Sheets

(56) References Cited

U.S. PATENT DOCUMENTS 5,525,314 A * 6/1996 Hurson ..... A61C 3/04 206/369
6,398,068 B1 * 6/2002 Geheniau ..... B65D 43/164 206/504
6,685,023 B2 * 2/2004 Bleggi ..... A45C 11/16 206/493
6,854,814 B1 * 2/2005 Gardner ..... A47F 3/00 312/138.1
7,150,365 B2 12/2006 Hardy et al.
7,299,934 B2 11/2007 Hardy et al.
7,451,881 B2 11/2008 Hardy et al.
7,510,078 B2 * 3/2009 Schmidt ..... B25H 3/003 206/372
7,621,409 B2 11/2009 Hardy et al.
7,661,545 B2 2/2010 Hardy et al.
7,828,158 B2 * 11/2010 Colelli ..... A47F 1/126 211/59.3
8,047,385 B2 11/2011 Hardy
8,109,402 B2 * 2/2012 Hartwall ..... B65D 19/18 220/7
8,113,601 B2 2/2012 Hardy
8,136,682 B2 3/2012 Hardy
8,157,337 B2 * 4/2012 Manalang ..... B25H 3/06 312/249.8
8,210,363 B2 7/2012 Hardy
8,215,520 B2 * 7/2012 Miller ..... A47F 3/002 221/129
8,235,227 B2 8/2012 Hardy
8,408,411 B2 * 4/2013 Hay ..... B65D 19/18 220/4.29
8,794,464 B2 * 8/2014 Yamauchi ..... B65D 11/1873 220/4.28
9,070,261 B2 * 6/2015 Hardy ..... A47F 3/002
9,481,386 B2 * 11/2016 Martell ..... B62B 3/003
9,687,085 B2 6/2017 Hardy
9,980,461 B2 * 5/2018 Kim ..... A01K 1/03
10,881,199 B1 * 1/2021 Le ..... F16B 12/26
10,906,723 B2 * 2/2021 Guerdrum ..... B65D 21/086
2005/0284908 A1 * 12/2005 Greenwood ..... B60R 11/00 224/547
2007/0181513 A1 * 8/2007 Ward ..... A47F 1/04 211/59.2
2008/0173325 A1 * 7/2008 McGarry ..... A47F 5/0807 132/315
2014/0374082 A1 * 12/2014 Pena ..... F24F 3/1411 165/222
2020/0273303 A1 * 8/2020 Ewing ..... A47F 3/002
2021/0369006 A1 * 12/2021 Pena ..... A47F 1/126

* cited by examiner

LOCKING CASE SYSTEM AND METHOD FOR COSMETIC PRODUCTS

CROSS REFERENCE TO RELATED APPLICATIONS

This application claims the benefit of U.S. Provisional Application No. 62/873,714 filed Jul. 12, 2019. The entire contents of this application are incorporated herein by reference in their entirety.

TECHNICAL FIELD

This disclosure relates to anti-theft systems for store products, and, more particularly, to a locking case system and method for cosmetic products.

BACKGROUND

Traditional in-store shelving arrangements include products disposed on a tray disposed on a shelf, for example. These shelving arrangements enable customers to easily access and remove products from the shelf. In one example, a tray houses numerous cosmetic products, such as in a row-by-row format, allowing the tray to be easily placed in an in-store shelf. In this configuration, any of the cosmetic products in any row of the tray can be easily accessed and removed.

While such arrangements provide easy accessibility and removal of the product for the consumer, the products are generally not secured and/or locked within the trays. Said another way, there are typically no anti-theft mechanisms for such trays disposed on in-store shelves, allowing large quantities of products to be easily and quickly stolen.

In fact, little if any locking and/or anti-theft mechanisms for in-store cosmetic products exist at least because of the unique designs for various cosmetic products. For example, many cosmetic products have different heights, shapes, and packaging configurations, requiring more custom locking mechanisms for each type of cosmetic product when they are displayed. Thus, for at least this reason, it has been difficult to develop a more universal anti-theft and/or locking mechanism suitable for many types of cosmetic products.

SUMMARY

In accordance with one exemplary aspect of the present disclosure, a locking case system for cosmetic products comprises a fixture adapted to receive cosmetic products. The fixture includes a pair of side walls, at least one side wall having at least one receiving portion, a rear wall having a top edge and at least one receiving aperture disposed in the top edge, and a front wall having at least one receiving aperture. A locking case is adapted to be coupled to the fixture for securing the cosmetic products to the fixture. The locking case includes a housing having a pair of side walls, at least one side wall including at least one snap member, a rear wall having at least one snap member, and a top portion. A door is rotatably coupled to the top portion and disposed in a front area of the housing between the pair of side walls. The door has a lower front edge. A front member is disposed between and coupled to the pair of side walls and has at least one snap member, the lower front edge of the door adapted to contact the front member when the door is in a closed position. So configured, upon coupling the locking case to the fixture, the at least one snap member of the at least one side wall of the locking case is snapped into the at least one receiving portion of the at least one side wall of the fixture. In addition, the at least one snap member of the rear wall of the locking case is snapped into the at least one receiving aperture in the top edge of the rear wall of the fixture. Further, the at least one snap member of the front member of the locking case is snapped into the at least one receiving aperture of the front wall of the fixture to secure the cosmetic products to the fixture.

In accordance with another exemplary aspect of the present disclosure, a locking case for cosmetic products is adapted to be coupled to a fixture to secure the cosmetic products to the fixture. The locking case comprises a pair of side walls, at least one side wall including at least one snap member, and a rear wall disposed between the side walls and having at least one snap member. The locking case also includes a top portion having a front area and a hinge disposed on the front area, and a door rotatably coupled to the front area of the top portion via the hinge and disposed between the pair of side walls, the door having a lower front edge. Further, a front member is disposed between and coupled to the pair of side walls and having at least one snap member. So configured, the lower front edge of the door is adapted to contact the front member when the door is in a closed position. In addition, each at least one snap member is adapted to contact one of a receiving aperture or receiving portion of the fixture to secure the cosmetic products to the fixture.

In accordance with yet another exemplary aspect of the present disclosure, a method of assembling a locking case system for cosmetic products is disclosed. The method includes inserting a projection on each end of a front member of a locking case into a hole on at least one side wall of the locking case. The method also includes simultaneously inserting at least one snap member of the at least one side wall of the locking case into a corresponding receiving portion of at least one side wall of a fixture, at least one snap member of a rear wall of the locking case into a receiving aperture of a top edge of a rear wall of the fixture, and at least one snap member of the front member of the locking case into a receiving aperture of the front wall of the fixture. The method still further includes installing a fastening member into an aperture of at least one of the at least one snap members, further coupling the locking case to the fixture and securing cosmetic products to the fixture.

In further accordance with any one or more of the foregoing aspects and methods, one or more of the locking case system, the locking case, and the method of assembling the locking case system may include any one or more of the following forms or method steps.

In one form, the rear wall of the fixture may include three receiving apertures disposed in the top edge. In addition, the rear wall of the locking case may include three snap members adapted to be snapped into the corresponding three receiving apertures in the top edge of the rear wall of the fixture to secure the locking case to the fixture.

In another form, the at least one side wall of the fixture further may include an inside surface having two receiving portions, at least one receiving portion rounded in shape. In addition, the at least one side wall of the locking case may include two snap members having a corresponding rounded shape, such that the snap members of the at least one side wall of the locking case fit within the corresponding two receiving portions of the side wall of the fixture to secure the locking case to the fixture.

In yet another form, the front wall of the fixture may include two receiving apertures and a shelf portion, and the front member of the locking case may include two snap members and a front edge. Each snap member may include a tab extending from the front edge, such that each tab of the front member of the locking case fits into the corresponding two receiving apertures of the fixture. In addition, the front edge of the locking case may rest on the shelf portion of the front wall of the fixture when the locking case is coupled to the fixture.

In still another form, the at least one side wall of the fixture may include an outside surface having at least one receiving portion, and the at least one side wall of the locking case may have a projection extending from a bottom portion of the at least one side wall. The at least one receiving portion of the side wall of the fixture may be adapted to receive the projection of the at least one side wall of the locking case when the locking case is coupled to the fixture.

In still another form, the at least one snap member may include a hole adapted to receive a fastening member for securing the snap member to one of the at least one receiving aperture of the top edge of the rear wall of the fixture, the at least one receiving portion of the inside surface of the at least one side wall of the fixture, and the at least one receiving aperture of the front wall of the fixture.

In another form, the at least one side wall of the locking case may include a pair of ribs extending across a length of the at least one side wall, each rib having an end with a rounded shape. The end is adapted to fit within the corresponding receiving portion of the at least one side wall of the fixture.

In still another form, the top portion may include a hinge extending along a front edge of the top portion, and the hinge may be rotatably coupling the door to the top portion of the locking case.

Still further, the front member may further include a body with an upper portion, a lower portion, and two ends. A pair of snap members may extend from the lower portion on either end of the body, and a shoulder portion may be disposed on the upper portion of the body. The shoulder portion may have an upwardly and vertically extending arm on either end of the body, and each arm may include a projection to be inserted into a hole in the side wall of the locking case.

In still another form, the fixture may be a tray or a tray insert adapted to receive cosmetic products, and the tray insert may be adapted to be disposed within the tray, the tray having a shelf for displaying a cosmetic product representative of the cosmetic products disposed within the tray insert.

In addition, the shoulder portion of the front member may include a gap adapted to accommodate a lock disposed on a lower portion of the door when the door is in a closed position.

In still another form, inserting a projection on each end of a front member of a locking case into a hole on at least one side wall of the locking case may comprise inserting the projection on each end of the front member into a hole on a front edge of each side wall of the locking case.

In addition, simultaneously inserting at least one snap member of the at least one side wall of the locking case into a corresponding receiving portion of at least one side wall of a fixture, at least one snap member of a rear wall of the locking case into a receiving aperture of a top edge of a rear wall of the fixture, and at least one snap member of the front member of the locking case into a receiving aperture of the front wall of the fixture may comprise one or more of simultaneously inserting two snap members of the at least one side wall of the locking case into two receiving portions of at least one side wall of a fixture, three snap members of a rear wall of the locking case into three receiving apertures of a top edge of a rear wall of the fixture, and two snap members of the front member of the locking case into two receiving apertures of the front wall of the fixture.

In yet another exemplary method, installing a fastening member into an aperture of at least one of the at least one snap members, further coupling the locking case to the fixture and securing cosmetic products to the fixture may comprise installing one or more of: (1) a fastening member into an aperture of the at least one snap member of the rear wall of the locking case and through the corresponding receiving aperture of the rear wall of the fixture; (2) a fastening member into an aperture of the at least one snap member of the at least one side wall of the locking case and through the corresponding receiving portion of the at least one side wall of the fixture; and (3) a fastening member into an aperture of the at least one snap member of the front member of the locking case and through the corresponding receiving aperture of the front wall of the fixture.

BRIEF DESCRIPTION OF THE DRAWINGS

The Figures described below depict various aspects of the system and methods disclosed therein. It should be understood that each figure depicts an example of a particular aspect of the disclosed system and methods, and that each of the figures is intended to accord with a possible example thereof. Further, wherever possible, the following description refers to the reference numerals included in the following figures, in which features depicted in multiple figures are designated with consistent reference numerals.

There are shown in the drawing arrangements which are presently discussed, it being understood, however, that the present examples are not limited to the precise arrangements and instrumentalities shown, wherein.

DETAILED DESCRIPTION

Generally, a locking case system for cosmetic products is disclosed. The locking case system includes a fixture, such as a tray insert, and a locking case coupled to the fixture to secure cosmetic products to the fixture and prevent large scale and/or rapid theft of the cosmetic products. The locking case includes a plurality of snap members, such that the locking case is able to snap into existing fixtures universally used in stores, such as trays or tray inserts for cosmetic products. Specifically, the locking case includes a housing having a pair of side walls, at least one side wall having at least one snap member, a rear wall having at least one snap member, a top portion, and a door rotatably coupled to the top portion and disposed in a front area of the housing between the pair of side walls. A front member is disposed between and coupled to the pair of side walls and include a snap member.

Upon coupling the locking case to the fixture, the at least one snap member of at least one side wall of the locking case is snapped into a receiving portion of at least one side wall of the fixture. In addition, another snap member of the rear wall of the locking case is snapped into at least one receiving aperture disposed on a top edge of a rear wall of the fixture, and another snap member of the front member of the locking case is snapped into a receiving aperture of a front wall of the fixture. Once each snap member is inserted into a corresponding receiving portion or receiving aperture of the fixture, a fastening member may be secured into and through a hole in each snap member to further secure the locking case to the fixture. Further, the door of the locking case may be moved to a closed position and a lock of the door moved to a locked state, completely securing the cosmetic products of the fixture in the locking case and preventing theft of the cosmetic products. So configured, the locking case is essentially tamper-resistant when assembled and secured to the fixture, as described above. In this way, the locking case is not able to be easily or quickly removable from the fixture, further preventing theft of cosmetic products stored within the fixture.

Figure 1:
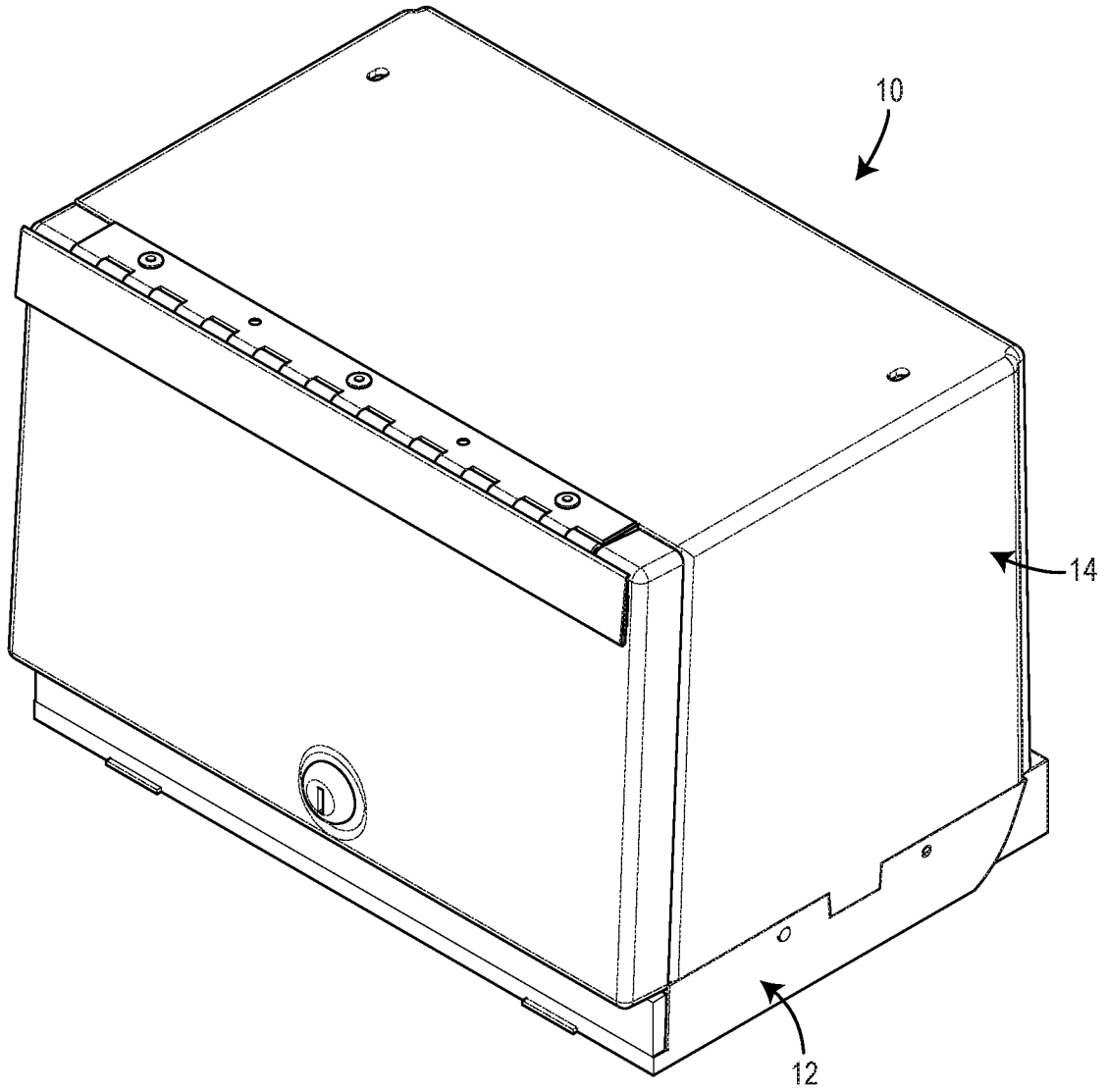
FIG. 1 is a perspective view of a locking case system according to an aspect of the present disclosure.

Referring now to FIG. 1, a locking case system 10 of the present disclosure is depicted. The locking case system 10 includes a fixture 12 adapted to receive cosmetic products (e.g., FIG. 15) and a locking case 14. The locking case 14 is adapted to be coupled to the fixture 12 to secure cosmetic products to the fixture 12. In one example, the fixture 12 is a tray insert that is commonly and universally used to display cosmetic products in many stores. In another example, the fixture 12 may be any other commonly used structure, such as a portion of commonly used in-store shelving arrangement, that houses and/or stores cosmetic products. The cosmetic products may include any known cosmetic product, including but not limited to any skincare products, such as No7 skincare products, lipsticks, foundation, creams, lotions, eyemake-up remover, blush, and/or any other cosmetic product typically merchandised in a similar manner, such as a vertical orientation.

Figure 2A:
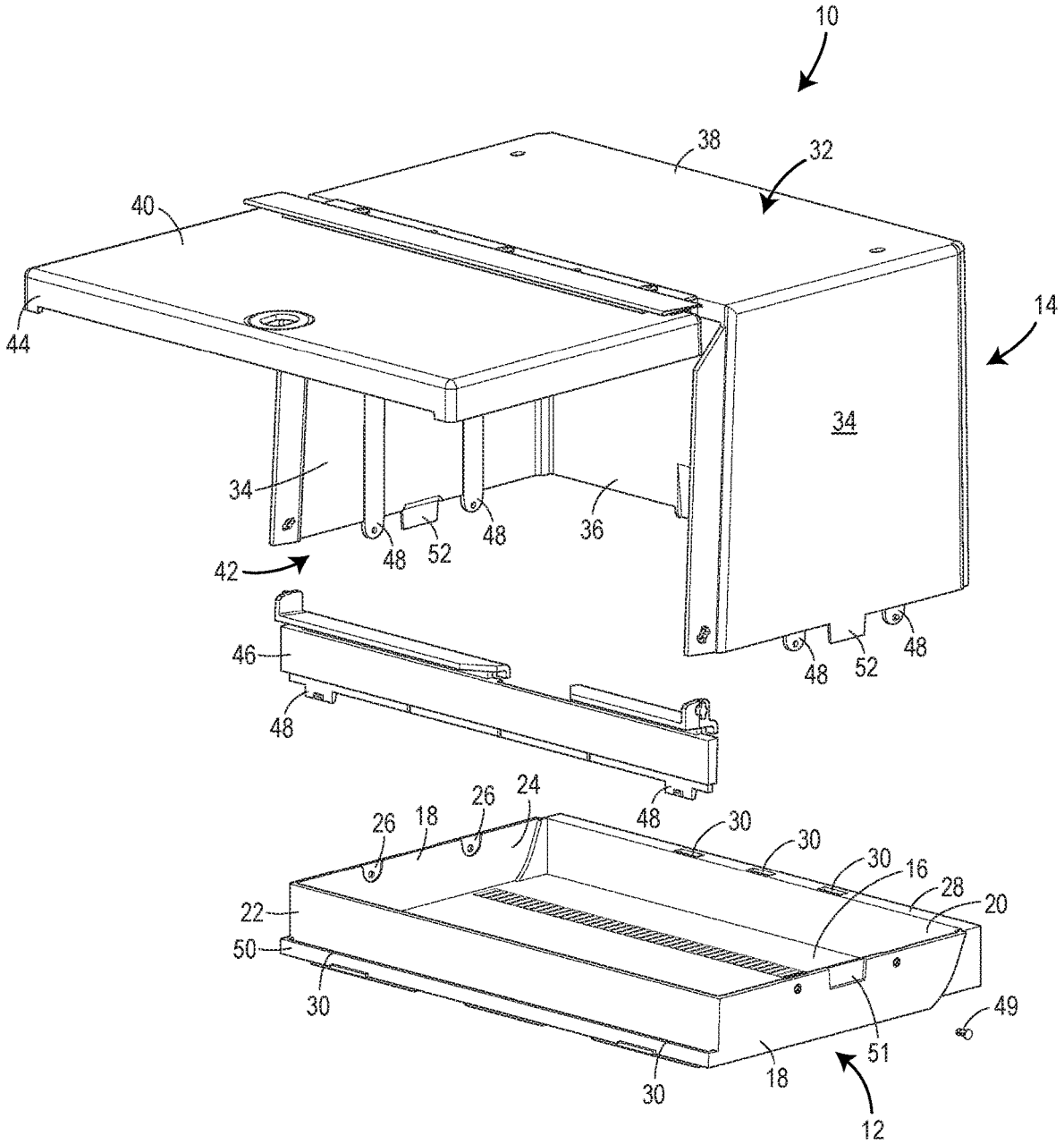
FIG. 2A is an exploded view of the locking case system of FIG. 1.

Referring now to FIG. 2A, an exploded view of the locking case system 10 is depicted. The fixture 12 includes a base 16 having a pair of side walls 18, a rear wall 20, and a front wall 22. The rear and front walls 20, 22 are disposed between the pair of side walls 18, forming an enclosure around the base 16. The cosmetic products are typically disposed on the base 16, such as in a vertical orientation and/or a row-by-row format. The pair of side walls 18 includes at least one side wall having an inside surface 24 with at least one receiving portion 26. In one example, both side walls of the pair of side walls 18 includes the inside surface 24 having two receiving portions 26. In addition, the rear wall 20 includes a top edge 28 having at least one receiving aperture 30. In one example, and as depicted in FIG. 2A, the top edge 28 includes three receiving apertures 30. Further, the front wall 22 also includes at least one receiving aperture 30, and in some examples may include two receiving apertures 30, as also depicted in FIG. 2A.

Still referring to FIG. 2A, the locking case 14 includes a housing 32 having a pair of side walls 34, a rear wall 36, a top portion 38, and a door 40 rotatably secured to the top portion 38. In this example, the door 40 is riveted to the top portion 38 of the housing 32 to prevent the door 40 from being quickly or easily removed from the locking case 14, further minimizing theft of the cosmetic products. The door 40 is disposed in a front area 42 of the housing 32 between the pair of side walls 34 and includes a lower front edge 44. The locking case 14 further includes a front member 46 disposed between and coupled to the pair of side walls 34, and the lower front edge 44 of the door 40 contacts the front member 46 when the door 40 is in a closed position, as explained more below.

As further depicted in FIG. 2A, the pair of side walls 34 includes at least one side wall 34 having at least one snap member 48. In one example, each side wall 34 includes two snap members 48, and more or fewer snap members 48 may be included on one or more side walls 34 of the pair of side walls 34 and still fall within the scope of the present disclosure. In addition, the rear wall 36 may also include at least one snap member 48, as further described below. Further, the front member 46 also includes at least one snap member 48. In one example, the front member 46 includes two snap members 48.

Upon coupling the locking case 14 to the fixture 12, the at least one snap member 48 of the at least one side wall 34 of the locking case 14 is snapped into the at least one receiving portion 26 of the at least one side wall 18 of the fixture 12. In addition, the at least one snap member 48 of the rear wall 36 of the locking case 14 is snapped into the at least one receiving aperture 30 disposed on the top edge 28 of the rear wall 20 of the fixture 12. Further, the at least one snap member 48 of the front member 46 of the locking case 14 is snapped into the at least one receiving aperture 30 of the front wall 22 of the fixture 12.

After coupling the locking case 14 to the fixture 12, a fastening member 49 may be inserted into a hole of the at least one snap member 48 of the at least one side wall 34 of the rear wall 36 or the front member 46. In FIG. 2A, the fastening member 49 is depicted in an aligned position with the receiving portion 26 of the side wall 18 of the fixture 12, such that when the at least one snap member 48 of the side wall 34 of the locking case 14 is snapped into the receiving portion 26 of the side wall 18 of the fixture 12, the fastening member 49 may then be inserted into the corresponding holes in each of the at least one snap member 46 and the receiving portion 26 to further secure the locking case 14 to the fixture 12.

Figure 2B:
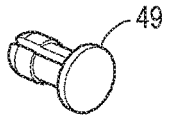
FIG. 2B is a perspective view of a fastener mechanism of the locking case system of FIG. 2A.

Referring now to FIG. 2B, a close-up view of the fastening member 49 of FIG. 2A is depicted. The fastening member 49 may include a rivet, such as a rivet having a domed head, that is easily inserted into the corresponding holes of the at least one snap member 46 and the receiving portion 26 of the side wall 18 of the fixture 12, for example.

However, and as will be appreciated, the fastening member 49 may alternatively be a clip (not shown) or any other mechanism capable of further coupling the locking case 14 to the fixture 12.

In some examples, the front wall 22 of the fixture 12 may include two receiving apertures 30 disposed near either end of the front wall 22 and a shelf portion 50 to accommodate portions of the front member 46 of the locking case 14, as described more below. In addition, the at least one side wall of the 18 of the fixture 12 may include at least one receiving portion 51 disposed on an outside surface of the side wall 18. In addition, the at least one side wall 34 of the locking case 14 may include a projection 52 extending from a bottom portion of the at least one side wall 34, as further depicted in FIG. 2A. So configured, the at least one receiving portion 51 of the side wall 18 of the fixture 12 receives the projection 52 of the at least one side wall 34 of the locking case 14 when the locking case 14 is coupled to the fixture 12.

Figure 3:
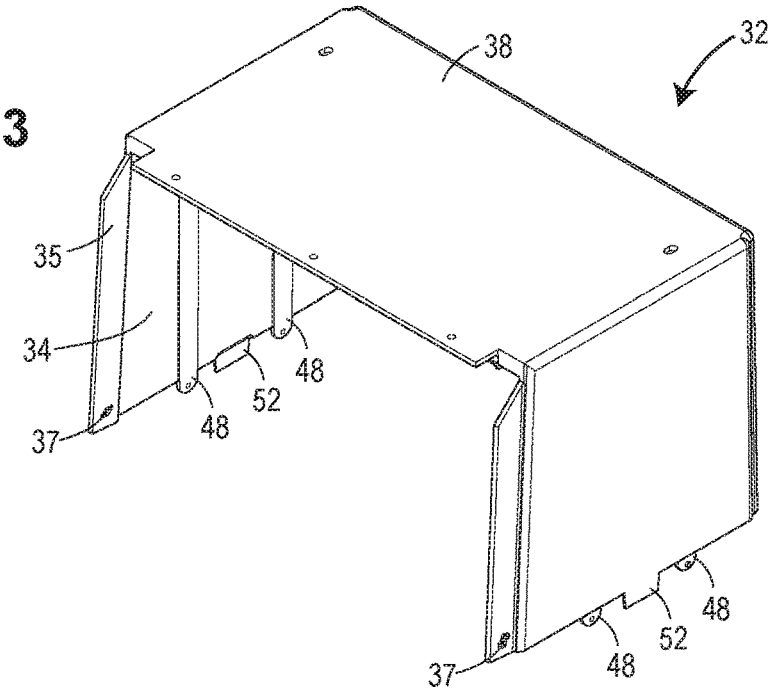
FIG. 3 is a perspective view of a portion of a locking case of the locking case system of FIG. 1.
Figure 4:
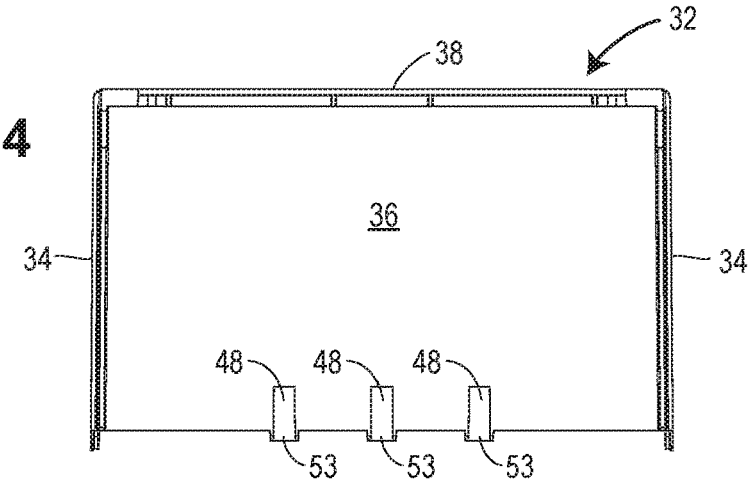
FIG. 4 is a front view of the portion of the locking case of FIG. 3.
Figure 5:
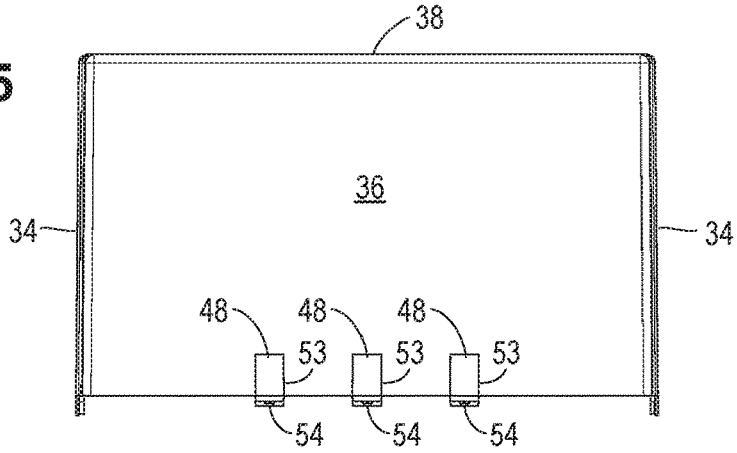
FIG. 5 is a rear view of the portion of the locking case of FIG. 3.

Referring now to FIGS. 3-5, a portion of the housing 32 of the locking case 14 is depicted. In this example, the rear wall 36 of the locking case 14 includes three snap members 48. The three snap members 48 are snapped into the corresponding three receiving apertures 30 disposed in the top edge 28 of the rear wall 20 of the fixture 12 (FIG. 2A). As will be appreciated, the rear wall 36 of the locking case 14 may have more or a fewer number of snap members 48 and still fall within the scope of the present disclosure. In one example, the snap members 48 of the rear wall 36 of the locking case 14 may include a rectangular projection 52 having a hole 54. In addition, while not depicted in the figures, the rear wall 20 may further include ventilation slots to accommodate existing LED lighting in the fixture 12, for example.

As depicted in FIG. 3, the at least one side wall 34 of the locking case 14 may include two snap members 48 having a rounded shape. In a similar manner, the corresponding receiving portions 26 of the side wall of the pair of side walls 18 of the fixture 12 may have the same rounded shape (FIG. 2A), enabling easy insertion of the snap members 48 into the fixture 12 when the locking case 14 is coupled to the fixture 12. In addition, the at least one side wall 34 of the locking case 14, and as depicted in FIG. 3, both side walls 34 include a front edge 35, which may be a flange, having a hole 37. Each hole 37 is adapted to receive a portion of a front member of the locking case 14, as explained more below. The front edges 35 of the side walls 34 help minimize gaps between the side walls 34 and the door 40 that would allow for easy prying of the door 40 from the top portion 38 of the housing 32.

Figure 6:
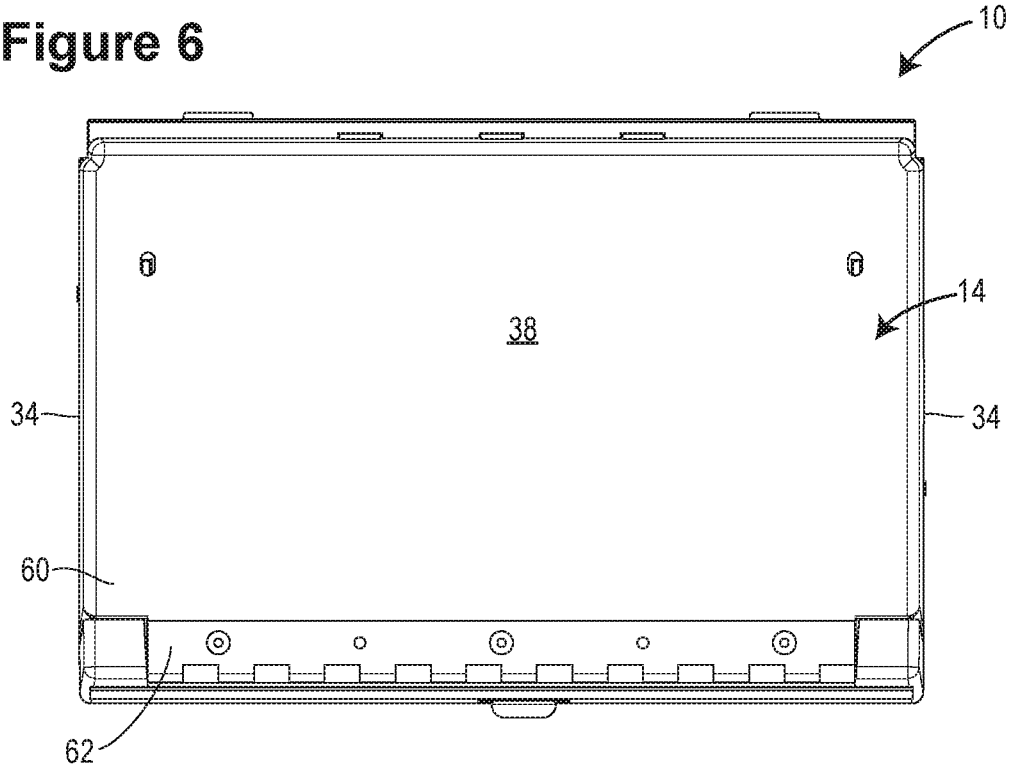
FIG. 6 is a top view of the locking case system of FIG. 1.

Referring now to FIG. 6, the top portion 38 of the locking case 14 includes a front edge 60 having a hinge 62 extending along the front edge 60. The hinge 62 rotatably couples the door 40 to the top portion 38 of the locking case 14, enabling the door 40 to be moved between a fully open position, as depicted in FIG. 2A, and a fully closed position, as depicted in FIG. 1.

Figure 7:
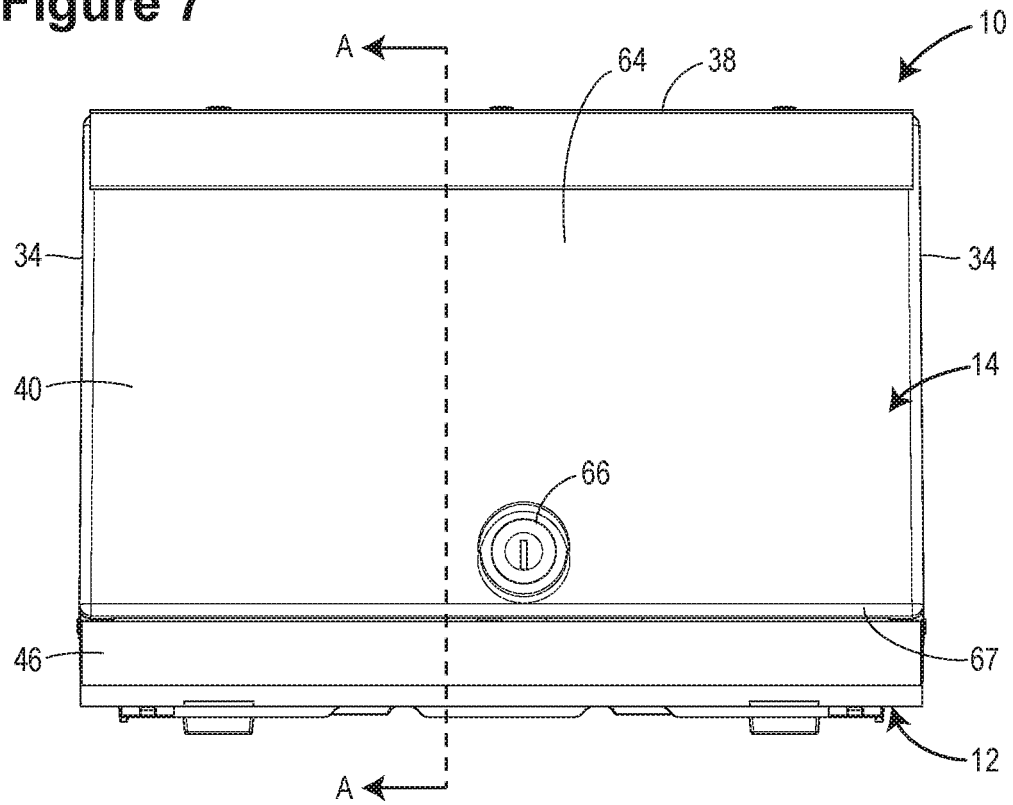
FIG. 7 is a front view of the locking case system of FIG. 1.

Referring now to FIG. 7, the door 40 further includes a center portion 64 and a lock 66 disposed in the center portion 64. So configured, after the door 40 is rotated to the closed position, the lock 66 may be moved to a locked position to lock the cosmetic products disposed in the fixture 12 within the locking case 14. When is it desired to remove cosmetic products from the fixture 12, the lock 66 may be moved to an unlocked position and the door 40 rotated to an open position, providing access to the cosmetic products within the locking case 14. While the lock 66 of FIG. 7 is disposed in the center portion 64 of the door 40, the lock 66 may alternatively be disposed in any other portion of the door 40 and still fall within the scope of the present disclosure. Further, the lock 66 may take the form of any known locking mechanism capable of providing a locked position and an unlocked position of the door 40 of the locking case 14, for example. Still further, in another example, the door 40 may include any other door configuration and/or mounting mechanism, such as a sliding door, and still fall within the scope of the present disclosure.

Figure 8:
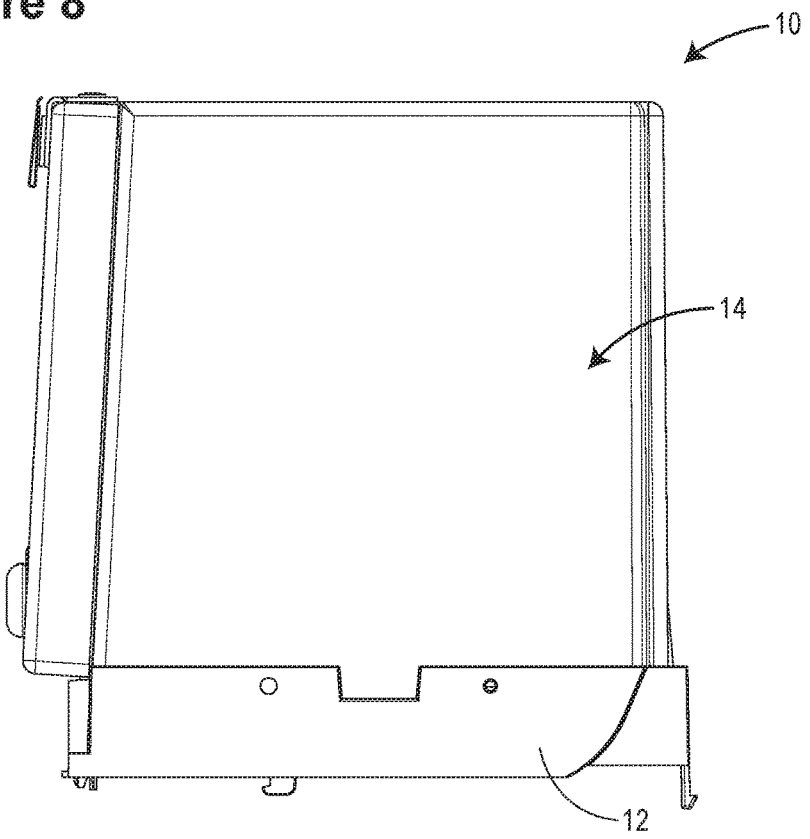
FIG. 8 is a side view the locking case system of FIG. 1.

As further depicted in FIGS. 7 and 8, the door 40 further includes a lower front edge 67. The lower front edge 67 is adapted to contact the front member 46 of the locking case 14 when the door 40 is in the closed position of FIGS. 7 and 8. In this example, the lower front edge 67 contacts the front member 46

Figure 9:
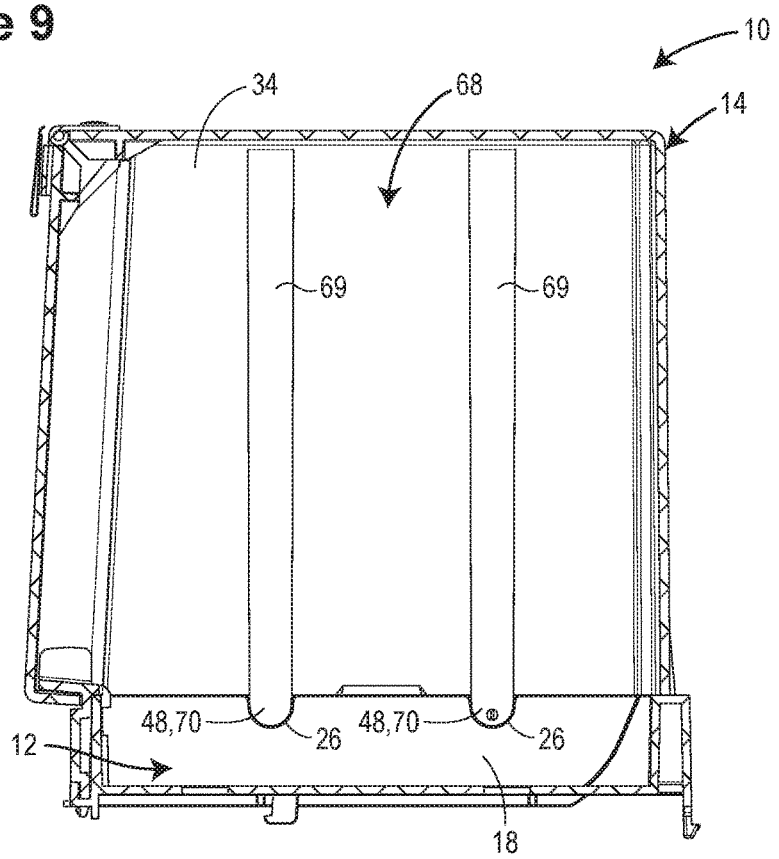
FIG. 9 is a cross-sectional view of locking case system taken along the line A-A of FIG. 7.

Referring now to FIG. 9, the at least one snap member 48 of the side wall 34 of the locking case 14 may include a rib of a pair of ribs 68 extending across a length of the at least one side wall 34. Each rib 69 of the pair of ribs 68 has an end 70 with a rounded shape. More specifically, in this example, the snap members 48 include the ends 70 that are adapted to fit within the corresponding receiving portions 26 of the side walls 18 of the fixture 12 when the locking case 14 is coupled to the fixture 12. In one example, each side wall 34 of the locking case 14 includes the pair of ribs 68, and each side wall 18 of the fixture 12 includes two corresponding receiving portions 26. So configured, the snap members 48 of the side walls 34 of the locking case 14 include a total of four ribs 69 with rounded ends 70 that fit within the corresponding four receiving portions 26 of the side walls 18 of the fixture 12.

So configured, when the locking case 14 is coupled to the fixture, the ends 70 are not easily deformed or misaligned with the receiving portions 26 of the fixture 12. This further enables the snap members 48 of the side walls 34 of the locking case 14 to be easily snapped into the receiving portions 26 of the fixture 12.

Figure 10:
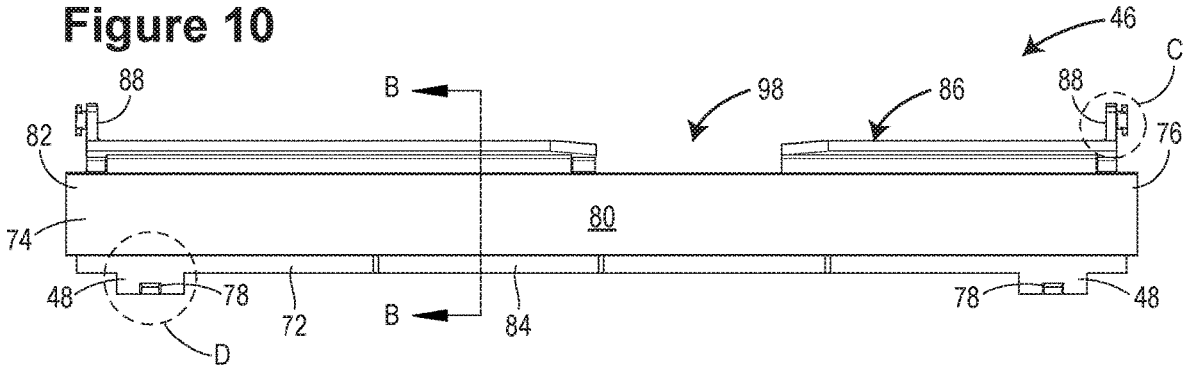
FIG. 10 is a front view of a front portion of the locking case of the locking case system of FIG. 2A.

Referring now to FIG. 10, the front member 46 of the locking case 14 is depicted. As noted, the front member 46 includes two snap members 48. The front member 46 also includes a front edge 72, such that each snap member 48 downwardly extends from the front edge 72. More specifically, in this example, the front member 46 includes a first end 74 and a second end 76 disposed opposite the first end 74; one snap member 48 downwardly extends from the front edge 72 near the first end 74, while the other snap member 48 downwardly extends from the front edge 72 near the second end 76. In addition, each snap member 48 of the front member 46 includes a tab 78. The tabs 78 fit within the corresponding two receiving apertures 30 disposed on the front wall 22 of the fixture 12 (FIG. 2A) when the locking case 14 is coupled to the fixture 12.

The front member 46 further includes a body 80 having an upper portion 82 and a lower portion 84, such that the snap members 48 downwardly extend from the lower portion 84 on each of the first and second ends 74, 76. A shoulder portion 86 is disposed on the upper portion 82 of the body 80 and includes an arm 88 near each of the first and second ends 74, 76.

Figure 11A:
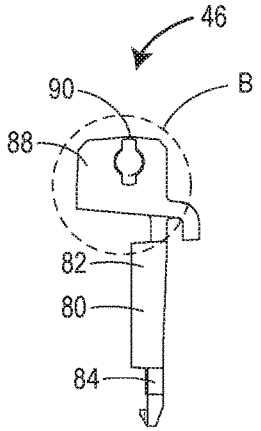
FIG. 11A is a side view of the front portion of FIG. 10.
Figure 12:
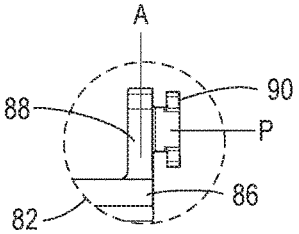
FIG. 12 is a close-up view of an area C of the portion of the locking case of FIG. 10.

As depicted in FIGS. 11A and 12, each arm 88 upwardly extends from the shoulder portion 86 and includes a projection 90. The projection 90 extends outwardly from each arm 88, such that the projection 90 is perpendicular relative to the arm 88. More specifically, the arm 88 includes a longitudinal axis A, and the projection 90 includes a lateral axis P that is disposed perpendicular to the longitudinal axis A, as depicted in FIG. 12.

Before the locking case 14 is coupled to the fixture 12, the front member 46 is assembled to the housing 32 of the locking case 14, as explained more below. Specifically, the front member 46 is first moved between the side walls 34 of the housing 32 of the locking case 14 near the front area 42 of the locking case 14 (see, e.g., FIG. 2A). So configured, the projections 90 extending from the arms 88 of the shoulder portion 86 are aligned with holes 37 on the side walls 34 of the locking case 14. The projections 90 extending from the arms 88 of the shoulder portion 86 near the first and second ends 74, 76 of the front member 46 are then inserted into the holes 37 on the side walls 34 of the locking case 14 to secure the front member 46 to the housing 32.

Figure 11B:
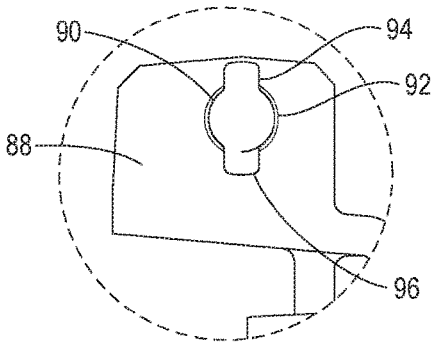
FIG. 11B is a close-up view of an area B of FIG. 11A.

As depicted in FIG. 11B, the projection 90 includes a circular portion 92 that helps the projection 90 more easily fit into the holes 37 of the side walls 34 of the locking case 14 during assembly of the locking case 14. In addition, a first flange portion 94 extends upwardly from the circular portion 92 and a second flange portion 96 extends downwardly from the circular portion 92. So configured, once the projections 90 are inserted into the holes 37 of the side walls 34 of the locking case 14, the first and second flange portions 94, 96 prevent the projections from moving out of the holes 37, providing a securing mechanism for the front member 46 to remain coupled to the housing 32 of the locking case 14. While the first and second flange portions 94, 96 extending upwardly and downwardly, respectively, from the circular portion 92, the first and second flange portions 94, 96 may alternatively extend from the circular portion 92 in any other direction and still fall within the scope of the present disclosure.

Referring back to FIG. 10, the shoulder portion 86 further includes a gap 98 disposed approximately in a center area of the shoulder portion 86. In the example of FIG. 10, the gap 98 is disposed slightly right of center of the shoulder portion 86, and may alternatively be disposed left of center or directly at the center of the shoulder portion 86 and still fall within the scope of the present disclosure. The gap 98 in the shoulder portion 86 is adapted to accommodate the lock 66 (FIG. 7) disposed on the door 40 of the locking case 14 when the door 40 is in the closed position.

Figure 13:
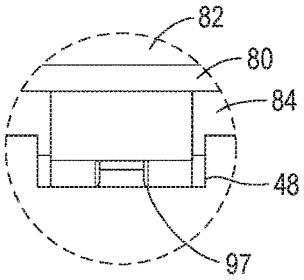
FIG. 13 is a close-up view of an area D of the portion of the locking case of FIG. 10.

As depicted in FIG. 13, the snap members 48 of the front portion 46 may include a hole 97 adapted to receive the fastening member 49 (FIGS. 2A and 2B) after the snap members 48 of the front portion of the locking case 14 are snapped into, e.g., inserted into, the receiving apertures 30 of the front wall 22 of the fixture 12.

Figure 14:
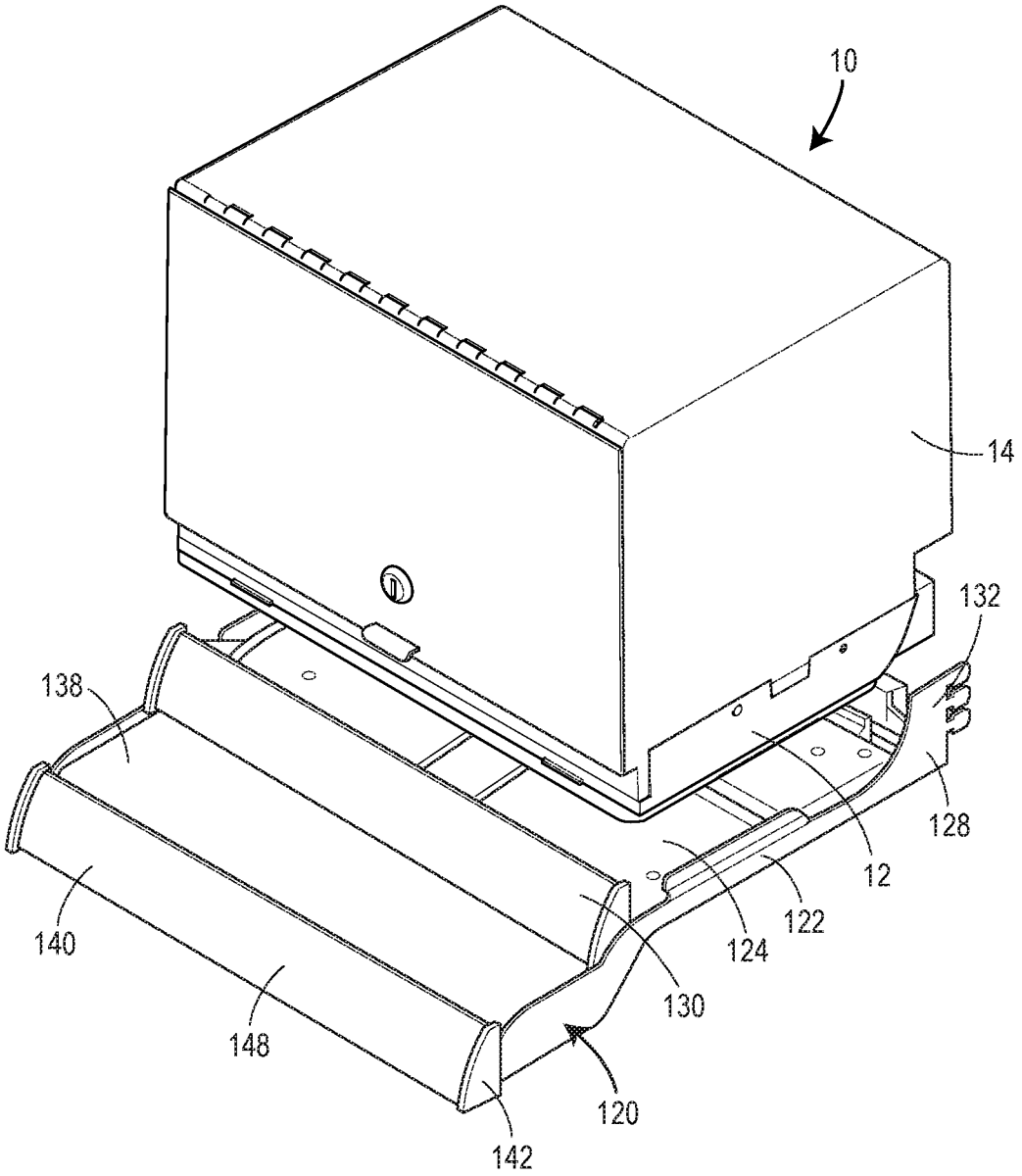
FIG. 14 is a perspective view of a locking case system according to another aspect of the present disclosure.
Figure 15:
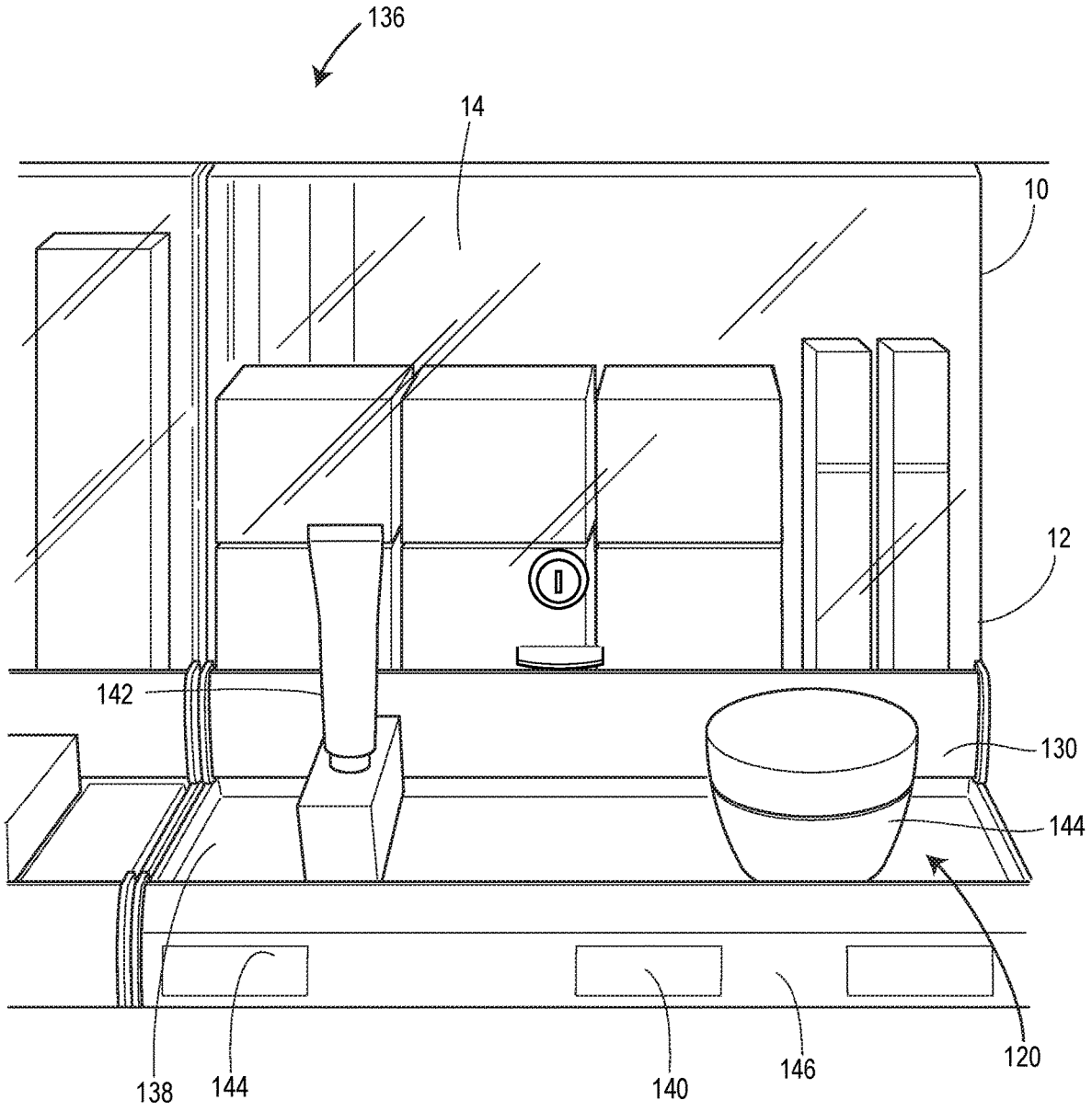
FIG. 15 is a front, perspective view of the locking case system of FIG. 14 disposed in a shelf and housing cosmetic products.

Referring now to FIGS. 14 and 15, the locking case system 10 of FIGS. 1-13 is depicted disposed on another in-store fixture, such as a tray for an in-store display shelf. More specifically, the locking case system 10 is disposed on a fixture 120 adapted to be coupled to an in-store shelf. The fixture 120 includes a base 122 having a receiving area 124 adapted to receive the locking case system 10. Said another way, the locking case system 10 easily fits into the receiving area 124 of the fixture 120, allowing the locking case system 10 to be coupled to the fixture 120 and ultimately a shelf, for example, as explained more below.

Specifically, the base 122 of the fixture 120 includes a rear portion 128 and a front portion 130. A coupling member 132 extends from each end of the rear portion 128, allowing the fixture 120 having the locking case system 10 disposed therein to be coupled to an in-store shelf 136, for example, as depicted in FIG. 15. The fixture 120 also includes a shelf 138 extending from the front portion 130 of the fixture 120 and a ticket holder area 140 extending from the shelf 138. The shelf 138 displays one or more cosmetic products for a customer to sample, such as a lotion 142 and/or a powder compact 144. In this way, the customer is able to evaluate for purchase the cosmetic product disposed on the shelf 138, which is representative of the cosmetic product(s) locked within the locking case system 10 coupled to the fixture 120, for example. By having only one or two representative cosmetic products displayed on the shelf 138 and the majority of cosmetic products for sale locked within the locking case system 10, the theft risk of a high number of cosmetic products typically disposed in the fixture 12 is significantly reduced, if not entirely eliminated, saving stores millions of dollars annually.

While the shelf 138 of FIG. 15 displays both the lotion 142 and the powder compact 144, any other cosmetic product (e.g., representative of the cosmetic products disposed within the locking case system 10) may alternatively be displayed and still fall within the scope of the present disclosure. Moreover, and as further depicted in FIG. 15, the ticket holder area 140 accommodates a price tag and/or a graphic label including a description of the cosmetic product, for example. In some examples, the ticket holder area 140 includes a slot 142 for receiving a price tag insert 144 and/or a graphic label 146 that is shown just below the sample products displayed on the shelf 138. The ticket holder area 140 includes a transparent front area 148, allowing any price tag insert 144 and/or graphic label 146 to be easily seen once inserted into the slot 142 of the ticket holder area 140, for example. In another example, a label and/or price tag may be directly adhered to the transparent front area 148 of the fixture 120, as will be appreciated.

In view of the foregoing, it will be appreciated that the locking system 10 is assembled according to the following exemplary method. In particular, and in one example, a method of assembling the locking case system 10 described above and depicted in FIGS. 1-13 comprises inserting the projection 90 on each end 74, 76 of the front member 46 of the locking case 14 into the hole 37 on the at least one side wall of the locking case 14. In one example, inserting the projection 90 on each end 74, 76 of the front member 46 of the locking case 14 into the hole 37 on the at least one side wall of the locking case 14 includes inserting the projection 90 on each end 74, 76 of the front member 46 into the hole 37 on each front edge 35 of each side wall 34 of the locking case 14.

In addition, the method further includes simultaneously inserting the at least one snap member 48 of the at least one side wall 34 of the locking case 14 into a corresponding receiving portion 26 of the at least one side wall 18 of the fixture 12, and at least one snap member 48 of a rear wall 36 of the locking case 14 into a receiving aperture 30 of the top edge 28 of the rear wall 20 of the fixture 12. Also at the same time, the at least one snap member 48 of the front member 46 of the locking case 14 is inserted into the receiving aperture 30 of the front wall 22 of the fixture 12. In one example, simultaneously inserting the at least one snap member 48 of the at least one side wall 34 of the locking case 14 into a corresponding receiving portion 26 of the at least one side wall 18 of the fixture 12, at least one snap member 48 of a rear wall 36 of the locking case 14 into a receiving aperture 30 of the top edge 28 of the rear wall 20 of the fixture 12, and at least one snap member 48 of the front member 46 of the locking case 14 into the receiving aperture 30 of the front wall 22 of the fixture 12 comprises one or more of simultaneously inserting two snap members 48 of the at least one side wall 34 into two receiving portions 26 of at least one side wall 18 of the fixture 12, three snap members 48 of the rear wall 36 of the locking case 34 into three receiving apertures 30 of the top edge 28 of the rear wall 20 of the fixture 12, and two snap members 48 of the front member 46 of the locking case 34 into two receiving apertures 30 of the front wall 22 of the fixture 12. In this way, and in this example, seven snap members 48 of the locking case 14 are disposed into one of a receiving aperture 30 or receiving portion 26 of the fixture 12. In another example, nine snap members 48 of the locking case 14, e.g., two snap members 48 for each side wall 34, are disposed into one of a receiving aperture 30 or the receiving portion 26 of the fixture 12.

Further, the method also includes installing a fastening member 49 into a hole 97 of at least one of the at least one snap member 48, such as the snap member 48 of the front member 46 of the locking case 14. This further couples the locking case 14 to the fixture 12 and secures cosmetic products to the fixture 12.

In view of the foregoing, it will be appreciated that the locking case system 10 and method of assembly include several advantages. For example, the locking case 34 includes a structure and corresponding snap members 48 that easily fit within existing fixtures, such as trays or tray inserts, of cosmetic products, keeping within the fixed width of the existing fixtures and requiring no tools for installation. This allows for efficient coupling of the locking case 34 to the cosmetic products fixture 12. Upon coupling the locking case 34 to the existing fixtures for cosmetic products, the locking case 34 may be further locked to the fixture 12 via the lock 66 to further secure the cosmetic products to the fixture 12. In any case, rapid and/or large amounts of cosmetic products are no longer able to be quickly removed, if at all removed, from the cosmetic products fixtures, significantly reducing the risk of large-scale theft of the cosmetic products. As a result, millions of dollars in annual lost sales due to such thefts are prevented, if not significantly reduced. In addition, the transparent door 40 and/or housing 32 of the locking case 34 provide a clear view of the cosmetic products inside the fixture 12. This allows both consumers to view the cosmetic products within the locking case system 40 and for store personnel to track inventory at the same time, while maintaining cosmetic products in the locked state.

The following additional considerations apply to the foregoing discussion. Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and functionality presented as separate components in example configurations may be implemented as a combined structure or component. Similarly, structures and functionality presented as a single component may be implemented as separate components. These and other variations, modifications, additions, and improvements fall within the scope of the subject matter herein.

As used herein any reference to "one implementation," "one embodiment," "one example," "an implementation," "an embodiment," or "an example" means that a particular element, feature, structure, or characteristic described in connection with the implementation is included in at least one implementation. The appearances of the phrase "in one implementation" or "in one embodiment" or "in one example" in various places in the specification are not necessarily all referring to the same implementation.

Some implementations may be described using the expression "coupled" along with its derivatives. For example, some implementations may be described using the term "coupled" to indicate that two or more elements are in direct physical or electrical contact. The term "coupled," however, may also mean that two or more elements are not in direct contact with each other, but yet still co-operate or interact with each other. The implementations are not limited in this context.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

In addition, use of the "a" or "an" are employed to describe elements and components of the implementations herein. This is done merely for convenience and to give a general sense of the invention. This description should be read to include one or at least one and the singular also includes the plural unless it is obvious that it is meant otherwise.

Upon reading this disclosure, those of skill in the art will appreciate still additional alternative structural and functional designs for a system and a process for inspecting a structure to estimate the condition of a structure through the disclosed principles herein. Thus, while particular implementations and applications have been illustrated and described, it is to be understood that the disclosed implementations are not limited to the precise construction and components disclosed herein. Various modifications, changes and variations, which will be apparent to those skilled in the art, may be made in the arrangement, operation and details of the method and apparatus disclosed herein without departing from the spirit and scope defined in the appended claims.

We claim:

1. A locking case system for cosmetic products, the locking case system comprising:

a fixture adapted to receive cosmetic products, the fixture including a pair of side walls, at least one side wall having at least one receiving portion, a rear wall having a top edge and at least one receiving aperture disposed in the top edge, and a front wall having at least one receiving aperture;

a locking case coupled to the fixture and for securing the cosmetic products to the fixture, the locking case including a housing having a pair of side walls, at least one side wall including at least one snap member, a rear wall having at least one snap member, a top portion, a door coupled to a front area of the housing between the pair of side walls, the door having a lower front edge, and a front member disposed between and coupled to the pair of side walls and having at least one snap member, the lower front edge of the door adapted to contact the front member when the door is in a closed position, where, upon coupling the locking case to the fixture, the at least one snap member of the at least one side wall of the locking case is snapped into the at least one receiving portion of the at least one side wall of the fixture, the at least one snap member of the rear wall of the locking case is snapped into the at least one receiving aperture of the rear wall of the fixture, and the at least one snap member of the front member of the locking case is snapped into the at least one receiving aperture of the front wall of the fixture to secure the cosmetic products to the fixture.

2. The locking case system of claim 1, the rear wall of the fixture including three receiving apertures disposed in the top edge, and the rear wall of the locking case including three snap members that are snapped into the corresponding three receiving apertures in the top edge of the rear wall of the fixture to secure the locking case to the fixture.

3. The locking case system of claim 1, the at least one side wall of the fixture further including an inside surface having two receiving portions, at least one receiving portion rounded in shape, and the at least one side wall of the locking case includes two snap members having a rounded shape corresponding to a rounded shape of the at least one receiving portion, such that the snap members of the at least one side wall of the locking case fit within the two receiving portions of the side wall of the fixture to secure the locking case to the fixture.

4. The locking case system of claim 1, wherein the front wall of the fixture includes two receiving apertures and a shelf portion, and the front member of the locking case includes two snap members and a front edge, each snap member including a tab extending from the front edge, such that each tab of the front member of the locking case fits into the two receiving apertures of the fixture and the front edge of the locking case rests on the shelf portion of the front wall of the fixture when the locking case is coupled to the fixture.

5. The locking case system of claim 1, wherein the at least one side wall of the fixture includes an outside surface having at least one receiving portion, and the at least one side wall of the locking case includes a projection extending from a bottom portion of the at least one side wall, the at least one receiving portion of the side wall of the fixture adapted to receive the projection of the at least one side wall of the locking case when the locking case is coupled to the fixture.

6. The locking case system of claim 1, wherein the at least one snap member includes a hole adapted to receive a fastening member for securing the at least one snap member to one of: (1) the at least one receiving aperture of the top edge of the rear wall of the fixture, (2) the at least one receiving portion of an inside surface of the at least one side wall of the fixture, and (3) the at least one receiving aperture of the front wall of the fixture.

7. The locking case of claim 1, wherein the at least one side wall of the locking case includes a pair of ribs extending across a length of the at least one side wall, each rib having an end with a rounded shape, the end adapted to fit within the receiving portion of the at least one side wall of the fixture.

8. The locking case of claim 1, wherein the top portion includes a hinge extending along a front edge of the top portion, the hinge rotatably coupling the door to the top portion of the locking case.

9. The locking case of claim 1, wherein the front member further includes a body with an upper portion, a lower portion, and two ends, a pair of snap members extending from the lower portion on either end of the body, and a shoulder portion disposed on the upper portion of the body, the shoulder portion having an upwardly and vertically extending arm on either end of the body, each arm including a projection.

10. The locking case system of claim 1, wherein the fixture is one or more of a tray insert or a tray, the tray including a shelf for displaying sample cosmetic products representative of the cosmetic products disposed in the locking case.

11. A locking case for cosmetic products, the locking case adapted to be coupled to a fixture to secure the cosmetic products to the fixture, the locking case comprising:

a pair of side walls, at least one side wall including at least one snap member;

a rear wall disposed between the side walls and having at least one snap member;

a top portion having a front area and a hinge disposed on the front area;

a door rotatably coupled to the front area of the top portion via the hinge and disposed between the pair of side walls, the door having a lower front edge; and a front member disposed between and coupled to the pair of side walls and having at least one snap member, where, the lower front edge of the door is adapted to contact the front member when the door is in a closed position, and each at least one snap member is adapted to contact one of a receiving aperture or receiving portion of the fixture to secure the cosmetic products to the fixture.

12. The locking case of claim 11, wherein one or more of: (1) the rear wall includes three snap members, (2) the at least one side wall includes two snap members, (3) the front member includes two snap members, and (4) the at least one snap member includes a hole adapted to receive a fastening member.

13. The locking case of claim 11, wherein one or more of: (1) the front member includes a front edge and the at least one snap member includes a tab extending from the front edge; and (2) the at least one side wall of the pair of side walls includes a bottom portion and a projection extending from the bottom portion.

14. The locking case of claim 11, the at least one side wall includes a pair of ribs extending across a length of the at least one side wall, each rib having an end with a rounded shape adapted to fit within a receiving portion of the fixture.

15. The locking case of claim 11, wherein the front member further includes a body with an upper portion, a lower portion, and two ends, a pair of snap members extending from the lower portion on either end of the body, and a shoulder portion disposed on the upper portion of the body, the shoulder portion having an upwardly and vertically extending arm on either end of the body, each arm including a projection adapted to be inserted into a corresponding hole disposed in a front portion of each side wall of the pair of sidewalls to secure the front member to the side walls.

16. The locking case of claim 15, the shoulder portion of the front member including a gap adapted to accommodate a lock disposed on a lower portion of the door when the door is in a closed position.

* * * * *